United States Patent [19]

Herschlag

[11] Patent Number: 4,697,847

[45] Date of Patent: Oct. 6, 1987

[54] PORTABLE UPHOLSTERED FURNITURE

[76] Inventor: Herbert Herschlag, 68-15 Groton St., Forest Hills, N.Y. 11375

[21] Appl. No.: 814,625

[22] PCT Filed: Apr. 30, 1985

[86] PCT No.: PCT/US85/00765

§ 371 Date: Dec. 30, 1985

§ 102(e) Date: Dec. 30, 1985

[87] PCT Pub. No.: WO85/05019

PCT Pub. Date: Nov. 21, 1985

Related U.S. Application Data

[63] Continuation-in-part of Ser. No. 605,564, Apr. 30, 1984, Pat. No. 4,632,459.

[51] Int. Cl.[4] ..... A47C 7/00

[52] U.S. Cl. ..... 297/440; 297/42; 297/445

[58] Field of Search ..... 297/440, 443, 444–445, 297/16, 42, 43

[56] References Cited

U.S. PATENT DOCUMENTS

| | | | |
|---|---|---|---|
| 335,037 | 1/1886 | Noel | 297/44 X |
| 2,151,985 | 3/1939 | Munroe . | |
| 2,829,707 | 4/1958 | Leibson . | |
| 2,929,076 | 3/1960 | Ake et al. . | |
| 3,799,611 | 3/1974 | Steinfeld . | |
| 4,225,179 | 9/1980 | Visconti | 297/440 X |
| 4,244,619 | 1/1981 | Yoshimura . | |

FOREIGN PATENT DOCUMENTS

| | | | |
|---|---|---|---|
| 2513016 | 10/1976 | Fed. Rep. of Germany | 297/440 |
| 634267 | 2/1962 | Italy . | |
| 2026312 | 2/1980 | United Kingdom | 297/440 |

*Primary Examiner*—Kenneth Downey
*Attorney, Agent, or Firm*—Amster, Rothstein & Ebenstein

[57] ABSTRACT

Portable upholstered furniture is defined by a laterally folding frame having a pair of laterally collapsible side arm frames and a pair of medially foldable parallelogram cross assemblies extending therebetween, at least one generally transversely flexible band of fabric or the like encircling the side arm frames and the cross assemblies, and a cushioned bonnet like upper assembly settable downwardly onto the side arm frames and the upper cross assembly, the encircling band being provided with a plurality of vertically extending strut members supporting the back portion of the cusion assembly and carrying support blocks for supporting the cross assemblies.

25 Claims, 14 Drawing Figures

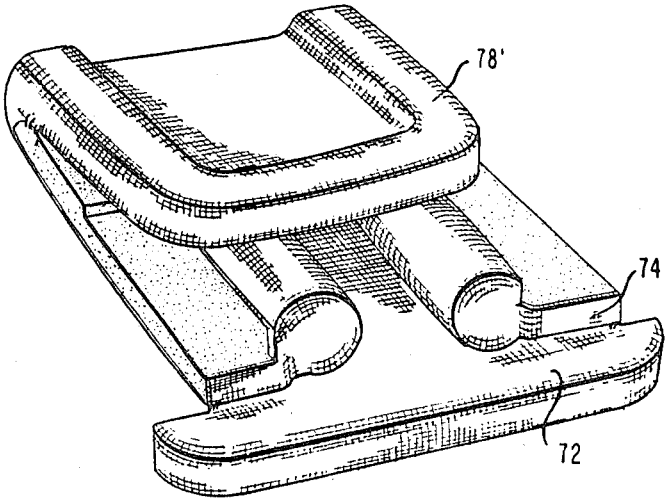
FIG. 8
FIG. 10
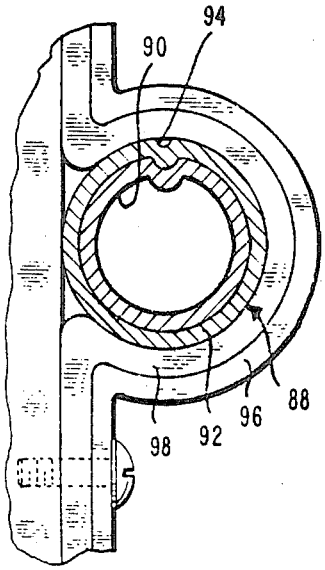
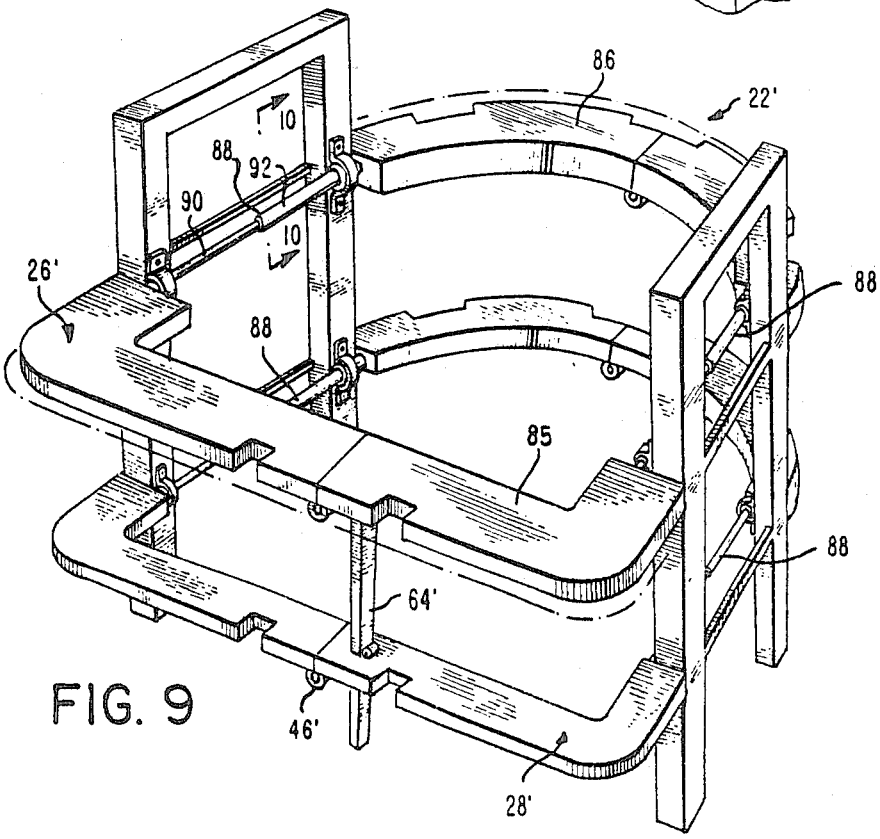
FIG. 9

PORTABLE UPHOLSTERED FURNITURE

This application is a continuation-in-part of application Ser. No. 605,564 filed Apr. 30, 1984, now U.S. Pat. No. 4,632,459.

TECHNICAL FIELD

This invention relates generally to furniture and, more particularly to portable furniture which may be easily stocked, transported, moved, or stored and which yet provides the comfort and appearance of conventional upholstered furniture.

BACKGROUND ART

Furniture, particularly furniture for sitting, such as chairs, loveseats, sofa, and sectionals, have heretofore been generally designed for either permanent use at a given location or for temporary use to be moved about easily. Such furniture for permanent use has generally been constructed with a rigid frame to which the upholstery is permanently attached so as to not generally be movable relative thereto (except, of course for removable cushions and the like). Such permanent type upholstered furniture is also generally heavy and bulky, being difficult to store and transport, generally requiring special facilities and handling by skilled movers or furniture handlers.

Portable furniture, on the other hand has been previously suggested, which may be easily stored and transported. Such furniture is generally designed to be as light in weight as practical and to either fold or stack for storage. Upholstery is generally minimal on such furniture, being limited to a simple seat cushion, perhaps a small back cushion, and rarely, small arm cushioning. Overall upholstery, however, is rarely provided, or clearly denotes the folding or temporary nature of the furniture.

Chairs, and the like, have also been heretofore suggested wherein bands of cloth or the like have been combined with frameworks, either folding or rigid, to provide slings for supporting people more or less comfortably. In some instances such bands or slings also provide some structural interaction with the frame members, as providing limits beyond which the frame members cannot extend. Hence, slings and frames have been combined into such furniture as director's chairs and butterfly chairs.

Further, slip covers have been heretofore suggested to be form fitted over chairs, settees, sofas, and the like, generally to enable the color or pattern of the upholstery to be easily changed, or to provide protection for the permanent upholstery of the piece. Such slipcovers, however, seldon if ever have any active cooperation with the framework and therefore do not provide any structural part of the furniture. Furniture wherein a removable fabric covering and a frame structurally interact heretofore required complex fastening systems therebetween. Ease of portability is therefore adversely effected, as are cost and weight of the assembly padded in the manner of conventional upholstered furniture and the overall design is limited substantially to the design shown in the patent drawings; little freedom of design is offered with only a straight line contour or parallelipiped being permissible between the side frame uprights. Hence, the design freedoms and appearance of conventional upholstered furniture can not be achieved.

DISCLOSURE OF INVENTION

In accordance with the present invention, portable upholstered furniture is defined by a laterally folding frame having a pair of laterally collapsible side arm frames and a pair of medially foldable parallelogram cross assemblies extending therebetween defining, in their unfolded configurations a horizontally extending seating support surface above and an auxilliary surface below; at least one generally transversely flexible band of fabric or the like encircling the side arm frames; and a cushioned bonnet like upper assembly settable downwardly onto the frame and band, cushioning the seating support surface and the arm portions of the side arm frame, and at least partially overlapping the encircling band. The encircling band may be permanently attached to the side arm frames or removably affixed thereto, if desired, for easy interchange. The encircling band may extend all the way to the floor for a full skirted apearance or the lower portion of the side arm frames may remain exposed as open leg portions. While in one embodiment or modification the side arm frames include upwardly extending arm portions, it is within the pervue of the present invention not only to provide furniture with both or all of the side arm frames including side arm portions, but also to provide furniture with only one arm and one side armless, the armless side having the side arm frame thereat truncated substantially at or adjacent the seat level with the arm defining portion thereof being eliminated, as for a sectional, or modular end or corner unit. Further, within the purvue of the present invention both arms can be eliminated and both side arm frames truncated substantially at or adjacent the seat level with the arm portion thereof being eliminated, as for an armless chair or sectional or modular unit. Yet further, more than two side arm frames may be used, as for multiple seating units, and any desired number thereof may be armless or with arm portions. Accordingly, throughout the following specification and the subjoined claims it shall be understood that the term side arm frame refers to the frame capable of including an arm portion whether or not it does so include an arm portion and whether or not it is truncated so as to be armless with the arm portion that could be included therewith has been eliminated.

The above and still further objects, features and advantages of the present invention will become apparent upon consideration of the following detailed description of several specific embodiments thereof, especially when taken in conjunction with the accompanying drawings.

BRIEF DESCRIPTION OF DRAWINGS

FIG. 8 is a perspective illustration of the upper bonnet-like cushioned portion of the chair of the preceding figures showing how the upper bonnet like portion may be readily removed and separately folded for transportation and storage; p FIG. 9 is a perspective illustration of another chair embodiment incorporating the principles of the portable upholstered furniture of the present invention;

FIG. 10 is an enlarged partial cross-section illustration taken along line 10—10 of FIG. 9;

BEST MODE FOR CARRYING OUT THE INVENTION

Figure 1:
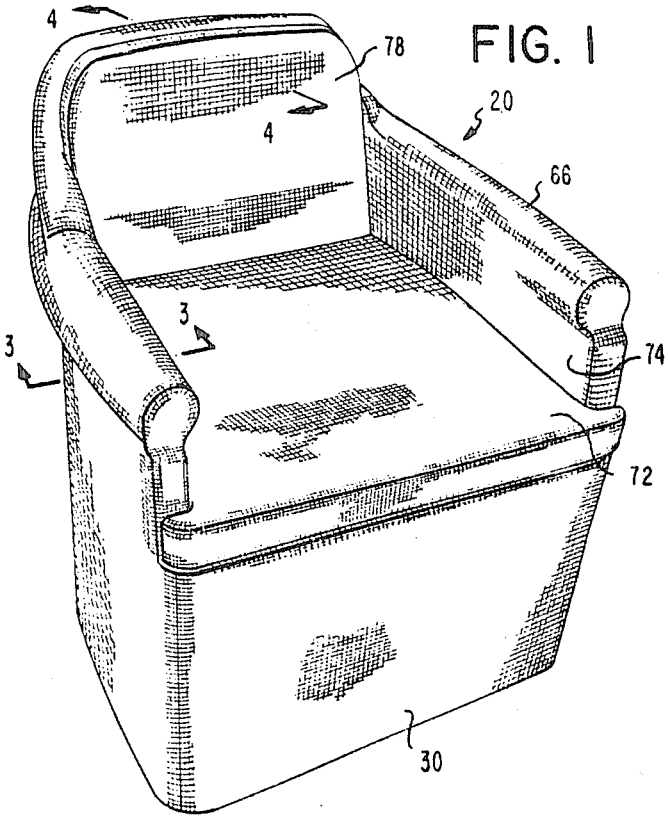
FIG. 1 is a perspective illustration of a chair incorporating the features of the portable upholstered furniture of the present invention.
Figure 3:
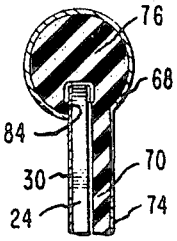
FIG. 3 is an enlarged cross-sectional partial view taken along line 3—3 of FIG. 1.

With reference now to the drawing, and particularly to FIGS. 1-14 thereof there is shown and illustrated an article of portable upholstered furniture constructed in accordance with my invention as specifically embodied in a portable upholstered chair designated generally by the reference character 20. While the chair 20 is illustrated as the type of chair that may be called a barrel chair, with the frame and legs being fully covered with the upholstery extending completely to the floor so as to cover the legs or leg substitute structure to be described in more detail hereinafter, it is to be expressly understood that it is the intent to cover within the ambit of my invention chair of other styles, including, by way of example and not by way of limitation chairs having various and diverse types of open framework such as chairs with extended and exposed legs, open arms, flat or curved panels, and the like.

Figure 2:
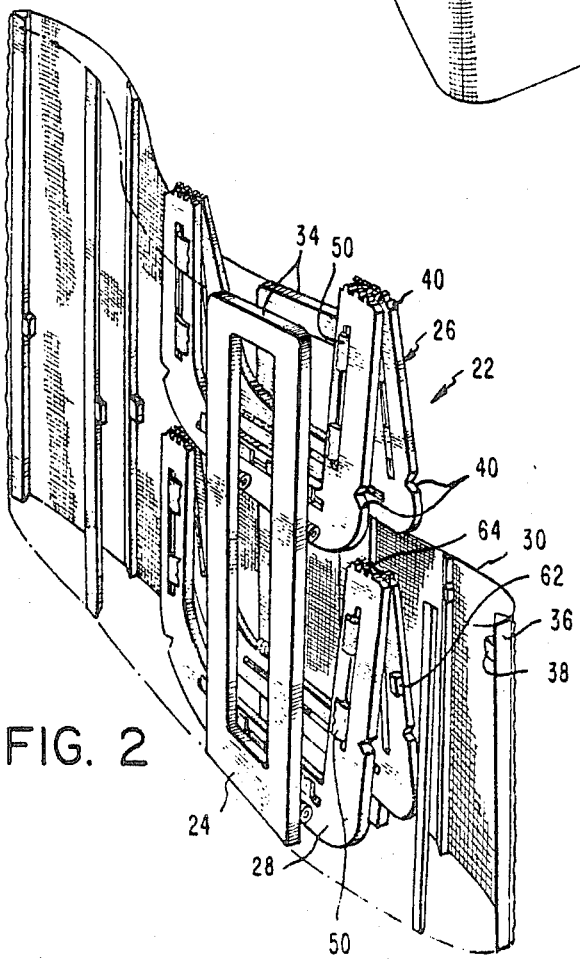
FIG. 2 is a perspective illustration of the chair of FIG. 1 with the upper or bonnet like cushioned portion removed therefrom and the lower frame portion thereof laterally collapsed for transportation or storage.
Figure 4:
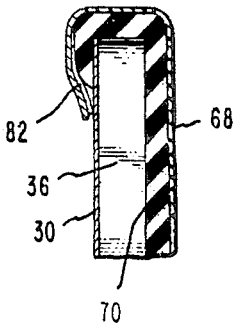
FIG. 4 is an enlarged cross-sectional partial view taken along line 4—4 of FIG. 1.
Figure 5:
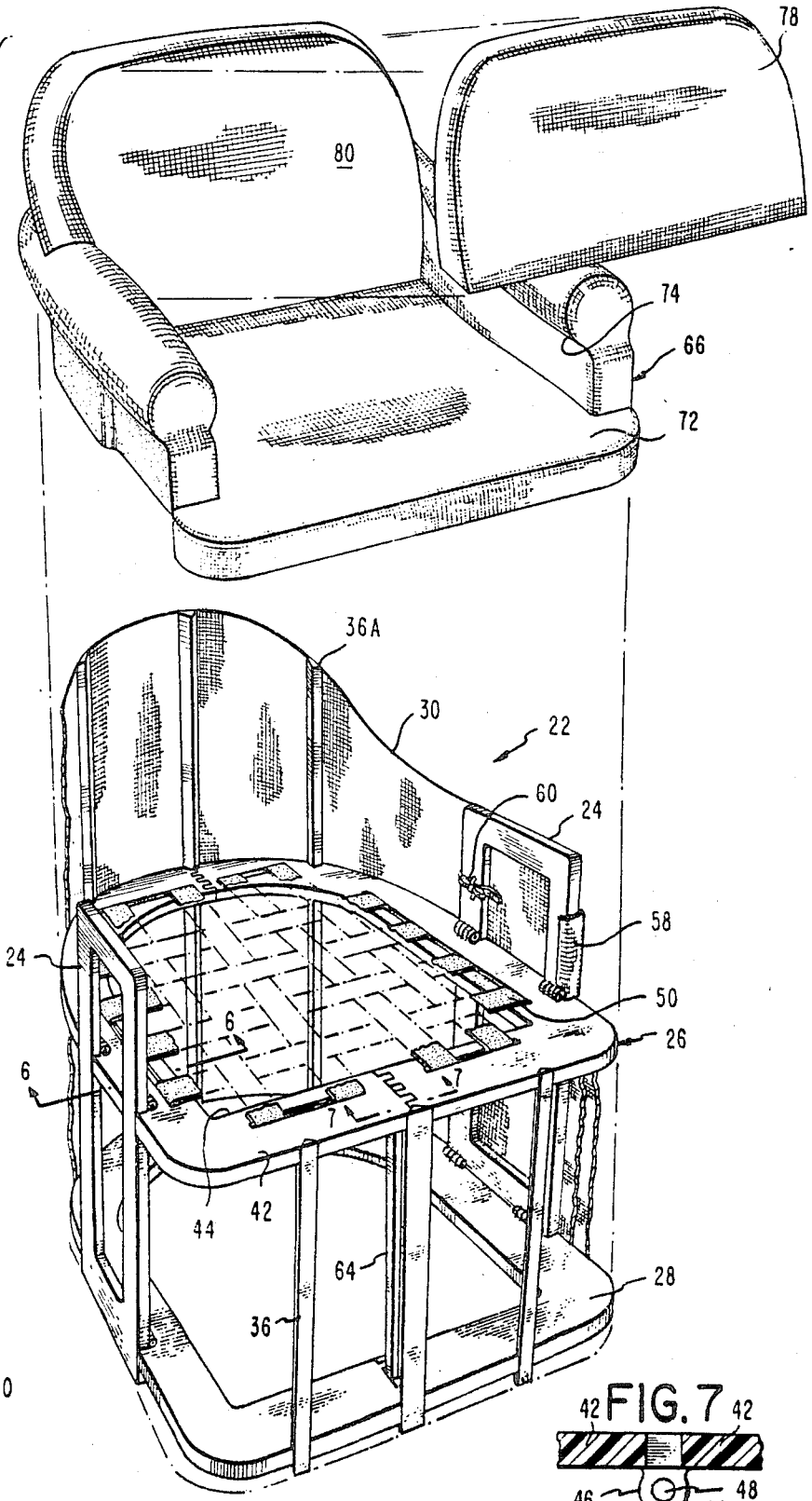
FIG. 5 is an exploded partially broken away perspective illustration of the chair of FIG. 1 showing how it may be easily assembled and disassembled.
Figure 6:
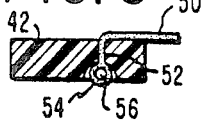
FIG. 6 is an enlarged cross-sectional partial view taken along line 6—6 of FIG. 5.
Figure 7:
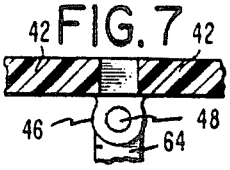
FIG. 7 is an enlarged cross-sectional partial view taken along line 7—7 of FIG. 5.

The exemplary chair 20, as best seen in FIGS. 2 and 5 comprises a laterally folding frame 22 having a pair of laterally collapsible side arm frames 24 and a pair of medially foldable parallelogram cross assemblies 26 and 28 extending therbetween defining in their unfolded configurations a horizontally extending seating support surface above and an auxiliary surface below. The chair further comprises at least one generally transversely flexible band of fabric or the like 30 encircling the side arm frames 24 and support surfaces 26 and 28 therebetween. Finally, the chair 20 includes a cushioned bonnet-like upper assembly 66 settable downwardly onto the frame 22 and band 30, cushioning the seating support surface 22 and the arm portions 34 of the side arm frames 24. The encircling band 30 may be provided with a plurality of vertically extending strut members 36 which may, for example, be adhesively adhered thereto and which, in the set up of unfolded orientation engage at least the peripheral portion of the seating support surface 26. In such engagement, the vertical strut members 36 may, for example, be provided with support block portions or members 38 upon which the seating support surface 26 rests and is supported when the chair or other article of furniture is in its orientation for seating use. In this manner, cross braces or latching mechanisms for the seating support surface 26 are not required and the support block members or portions 38 function as positive stops against excessive downward movement of the seating support surface and providing the feel of rigidity associated with permanent upholstered furniture and oftentimes missing in conventional folding furniture.

The at least partial peripheral engagement of the encircling band 30 with the seating support surface 26 contributes both structurally and aesthetically to the utility of my furniture of the present invention. The band 30 adds to and actually forms an integral assembly with the laterally foldable or collapsible frame 22 and together therewith provide the rigidity and solidarity usually only associated with permanent upholstered furniture. In addition, although the band 30 is generally flexible, in the set up configuration it is fully supported and therefore allows for a diverse range of design or appearance option to be fully implemented, especially if the curved surfaces are restricted to convex curves. Limited concabe surfaces may, however, also be implemented, although additional or supplementary stiffening thereof may be desirable. The encircling band 30, although basically flexible, is as heretofore pointed out a basic structural part of my furniture and provides rigidity and solidarity thereto. While the encircling band is preferably comprised of a decorative and durable fabric, other materials may be used, ranging, for example from metal sheet or foil to paper and other disposable materials. Corrugated cardboard, especially with the corrugations running vertically may be used. Of course, use of cardboard would not readily permit of permanent use, nor use for extended periods outdoors, but proper material selection would permit easily of all-weather or outdoor furniture. As used herein, however, the term fabric is intended to cover use of all such materials. Preferably, however, I have found that a fabric having limited stretch is preferable, and laminated structures, such as relatively thin fabric laminated to buckram has been found successful. Tyvek is also good.

The seating support surface 26 may be formed in a number of differing manners. For example, the seating support surface 26 may comprise two simple planar members of wood or the like, or may be molded, for example of plastic material so as to provide some resiliency in the central portion thereof for user comfort. Preferably, however, and as shown, the seating support surface 26 comprises a pair of generally U-shaped or bow shaped frame pieces 42 defining the periphery of the seating support surface 26 and providing fenestration 44 in the central portion thereof when the chair 20 is in the set up configuration as shown, for example in FIG. 6. The two pieces 42 may be hinged together at their ends, as by integrally formed hinge parts 46, hingedly interconnected as by a hinge pin 48 as shown in more detail in FIG. 7. The center portions of the members 42 may be similarly hinged to the arm frames 24. In each instance, the hinge pins are preferably offset sufficient to enable the various panels to fold completely, that is, flat one against the other. Across the central fenestration 44, a resilient support surface may be strung defined, for example, by spring material such as zig-zag spring wire or, as shown, interlaced or interwoven webbing strips 50 which may be secured to the frame pieces 42 in any convenient manner. For example, as shown in the detail, FIG. 6, the ends of the webbing strips 50 may pass through slots 52 and be provided with end loops 54 held in position by means such as pins or rods 56 extending therethrough. In this manner a very comfortable and durable seating surface can be formed which is yet easily folded, light in weight, and, if the strips 50 are of plastic or the like may be weather resistant. The seat may also be solid.

The fabric band 30 is generally movable relative the frame allowing the chair to be easily folded to a flattened configuration as shown in FIG. 2 for transportation and storage. Yet, when the chair is unfolded the band 30 forms a tight band therearound as shown in FIG. 5. The chair can be easily collapsed or folded by a slight upward pull to the seating support surface 26, or the webbing 50 easily followed by inward movement of the side arm frames 24. Just as easily, an outward pull on the side arm frames 34, followed by a downward push against the seating support surface against the support blocks or stops 38 sets up the frame. No other locks, only the friction and orientation of the seat support surface against the band 30 and vertical struts 36 and 36A. Although generally movable relative the frame, the band 30 is preferably attached to the side arm frames 24, in at least limited locations so that the band 30 and the frame portions 24, 26, and 28 may be conveniently handled as an integral unit. In addition, portions of the frame not to be exposed but not on the peripheral surface of the chair 20, such as the outside corners of the side arms above the cushion level may be thereby covered to complete the upholstered character of the chair. Hence, the outside upper corners of the side arm frames are covered by extensions of the band 30 designated by the reference character 58, see particularly FIG. 5. This attachment may be permanent, as by glue, adhesive, nails, decorative or plain tacks, and the like or may be more easily removable as for cleaning or changing of the cover, as by snap fasteners, interlocking loop and pile fabrics such as sold under the trademark Velcro, and the like. Additional fastening may be provide, such as ties 60.

As heretofore pointed out a lower folding surface 28 is preferable for additional strength and rigidity, and to increase the stability both of the structural support members and of the fabric band 30, adding to the sturdy, upholstered character of appearance of the chair 20. This lower frame or surface 26 may be identical or generally similar to the seating support surface 28, except that the seat webbing 50 is not needed. Further, the surface or frame 28 need only be parallel to the seating support surface 26. The lower surface 28 may be at the floor line, although is preferably spaced slightly above the floor line so as to avoid floating thereof if the chair 20 is used, for example on grass or high pile carpeting. Support blocks (not shown) may be provided on the vertical struts or (as shown in FIG. 2) support blocks 62 may be provided on the surface 28 itself. However, such support blocks are not generally needed—the lower surface 28 is not generally intended to carry the user's weight. Rather, as pointed out above it fills out the chair contours and provides rigidity to the overall structure. The lower surface 28 is connected for movement, folding and unfolding with the upper or seating surface 26. Means, such as a tie-bar 64 hinged at top and bottom to the upper surface 26 and the lower surface 28 provide the desired connection. Additional tie-bars can be provided but generally are not needed. Again, it is not intended that the tie-bar or tie-bars carry the user's weight. Rather, the tie-bar 64 is an aid in collapsing or folding the chair and in unfolding or setting it up by keeping the frames 26 and 28 parallel. Hence, in setting up the chair, a slight downward push on the upper seating surface or the frame thereof, will be transmitted by the tie-bar to the lower surface or frame 28 and will therefore position it properly and maintain it in that position. This is one of the reasons that the blocks 62 are not generally necessary. On the other hand, rigid tie-bars and blocks such as those at 62 can provide a secondary path for the weight of the user, if desired but, in general, only add to the cost, complexity, weight, and compactness of the folded chair. As detailed in FIG. 7, the tie-bar 64 may have its ends journaled on the same pins 48 as are used to hinge the frames 26 and 28 together. If desired, the lower frame 28 may be substantially narrower and lighter than the seating support surface, or for convenience of manufacture and parts inventory may be identical thereto. The tie-bar 64, of course, also aids in collapsing the chair, a simple upward pull to the upper or seating support surface is also transmitted there-through to the lower surface 28.

As will now be apparent, the band 30 provides an upholstered look to all of the exposed surfaces of the chair 20 which in ordinary usage are only visually perceived and not tactilly perceived. That is, the band 30 covers the lower and rearward surfaces against which the user's body does not bear or rest in normal use. Hence, the physical needs for cushioning are not present and cushioning thereof may generally be dispensed with, although cushioned fabrics may, of course, be used, as may geneally any type of treatment which might enhance the visual appearance or impact. Differences, however arise in those areas or regions in which tactile impression is significant. These areas generally are the upper and forward directed surfaces of a chair. In accordance with the present invention, these regions are covered and upholstered in their entirety by a bonnet like cushioned and upholstered unit or asssembly 66 which generally although not necessarily is entirely constructed of flexible materials and does not generally contain any rigid elements, except as will be pointed out hereinafter, so that it also may be easily collapsed although by a different mechanism than the lower unit.

The bonnet like upper unit 66 is, therefore, primarily constructed of fabric and cushioning material, such as plastic or rubber foam. The fabric cover material 68 may completely encase the cushioning 70, as by being sewn therearound as in conventional pillow or cushion construction. Alternatively, those portions not usually seen in use may be covered with a simple inexpensive fabric and, again, conventional sewing techniques may be used. On the other hand, techniques not usually associated with conventional upholstered furniture may also be used, such as laminating and bonding techniques, either laminating covering fabric 68 to pre-cut or formed cushions 70 by adhesive processes or the cushioning 70 may be even formed against and thereby bonded to the covering fabric 68 in molds or the like as has become common in special purpose maufacture such as automobile and other vehicular seats.

Regardless of how formed, however, the bonnet like upper assembly or portion 66 is intended to be assembled with the lower set up assembly by the simple expedient of lowering it into position, with such minimal hand position of specific fabric edges and the like, and smoothing as may be necessary. The bonnet like upper assembly or unit 66 provides upholstery and cushioning of the seat 72, inner arms 74 above the cushioning of the seat 72, and upper arm edges or rolls 76. In the inner or forward back region, I have found it expedient to provide all or the main cushioning by a separate pillow type cushion 78 of boxed construction. This provides for easier collapse or folding of the upper bonnet-like assembly or unit, as will be seen hereinafter, by reducing the amount of the cushioning 70 that need so be folded or compressed. Preferably, similar rolling of cushion material 70 extends in the unit 66 from the arm rolls 76 across the top of the chair back 80 to provide both stiffening to the upper assembly or unit 66 and padding of the chair back edge should someone rest an arm or hand on it. The seat cushioning should be thick, the inner arm cushioning thinner and the arm and back rolls, heavier and somewhat lighter, respectively. The inner back area may be totally uncushioned, except for the separate back cushion 78, or may be very lightly cushioned for additional body to the unit 66.

Generally, as described, the unit 66 comprises only fabric and cushioning, and simply drops into position on the lower unit 22. However, the lower margin of the back edge roll may be provided with a thin elastic band 82 for a snugger fit. Also, the arm rolls 76 may be provided with stiffening to aid in holding them in position and neat, such as a relilient channel member 84 of inverted generally U-shaped configuration, which may tightly engage the upper edge of the arm frame 24. The bonnet-like upper unit or assembly 66, as heretofore pointed out, also folds generally flat, which then, with the back cushion 78 and the frame 22 also folded or collapsed forms a very flat and compact package. With reference now to FIG. 8, the side arm cover portions 74 may be folded towards the center of the cushion portion 72, and then the back portion 78 folded on top thereof.

A tight fit of the fabric band 30 peripherally around the surfaces 26 and 28 is important for both rigidity and appearance. In order to enable manufacturing tolerances and the like to be accommodated, it is desirable that at least one of the band 30 and the frame 22 be adjustable during assembly. With reference now to FIG. 9, there is shown and illustrated another embodiment of collapsible frame designated by the reference character 22' which may, in essential detail be substituted for the frame 22 of the preceding figures but which allows for easy adjustment during assembly.

In describing the assembly 24', like reference characters are used for the several parts as in the previous figures, and where the several parts are similar but with modification, the reference characters are primed. Similar convention is used in FIG. 10 which is an enlarged detail of FIG. 9 and in FIG. 11 which shows another embodiment, wherein modified parts bear like reference characters, but double primed. The upper or seating support surface 26' and the lower surface 28' of the assembly 24' comprise forward and rearward portions 84 and 86 joined by hinges 46'. The portions 85 and 86 also are joined front to back by pivot bar assemblies designated generally by the reference character 88 telescopingly comprising inner and outer tubular members 90 and 92 respectively fixed, for example, to the front and rear portions 84 and 86, although front to inner or rear to inner is of no import. The important aspect is that they form pivots for the seating surface 26' and the lower surface 28' relative the arm frames 34' and, also, that they are capable of telescopic; movement for length adjustment, i.e., depth of seat. For example, and with particular reference to FIG. 10, during manufacture an appropriate fabric band may be installed, and then the tubes 90 and 92 telescoped outwardly or extended against the resistance of the fabric band so as to be tight, and then locked in position, as by being deformed by dimpling 94.

The tubes 90 and 92 also provide for the hinging action relative the side arm frames 34' which may be provided, for example by curved straps 96 and nylon or other plastic bushing members between the straps 96 and the tubes 90 and 92. The straps 96 may be attached to the side arm frames 34 in any convenient manner, as by screw, rivets, or the like, or may comprise apertured bosses, or the like, integrally formed with the side arm frames 34.

Figure 11:
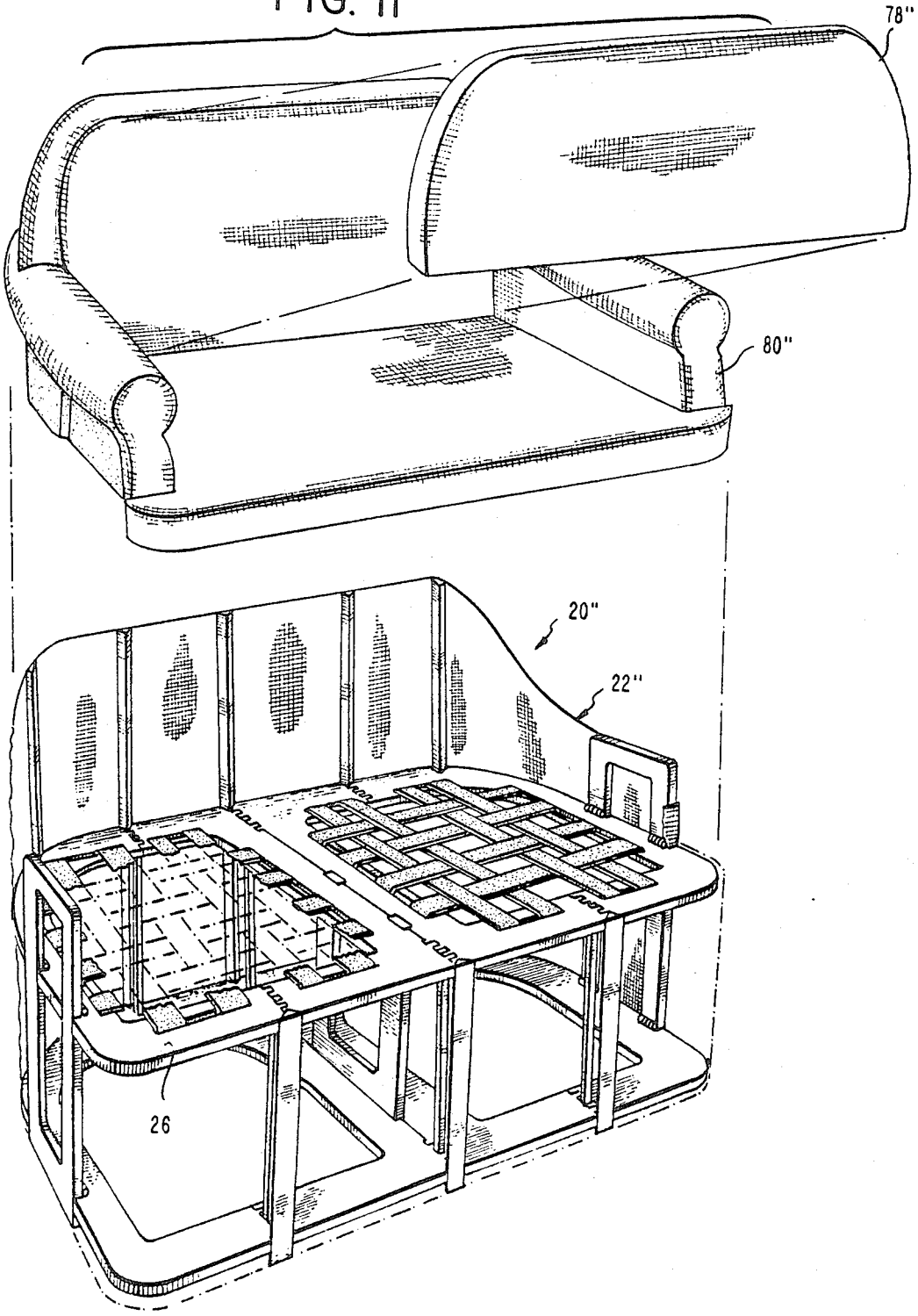
FIG. 11 is an exploded perspective illustration similar to FIG. 5 of another embodiment of portable upholstered furniture in accordance with the present invention as embodied in a two-seater sofa or loveseat.

As heretofore pointed out, it is an aspect of the present invention that it is applicable to diverse types and styles of furniture, and with reference now to FIG. 11 there is shown and illustrated a two seater setee or loveseat constructed in accordance with the present invention. Of course, a two seat setee or loveseat could be constructed utilising only the structural embodiment of FIGS. 1–7 merely by making the seat sufficiently wide relative the seat depth. However, preferably the principles of the present invention are applied with more imagination to maintain the ease of handling of the present invention while retaining the seating or support qualities of separately springing or supporting each user. Accordingly, a setee or loveseat designated 20" is shown and illustrated having two seating support surfaces 26 arranged side by side, on either side of a truncated side support 34" which does not extend above the seating support surfaces 26. Except for the wider width and the need to fold each side separately, the structural details are similar to that of the previous embodiments.

Figure 12:
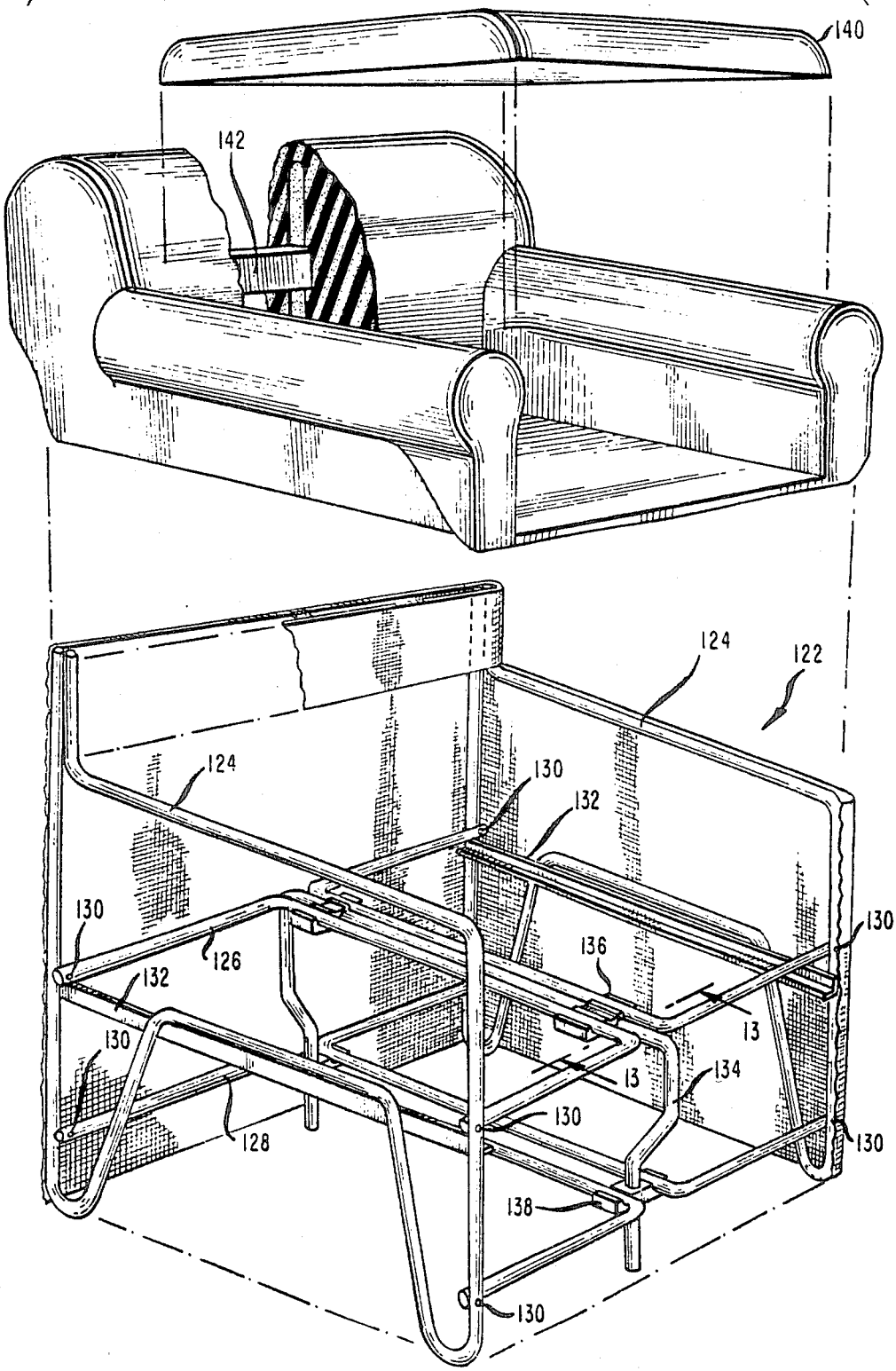
FIG. 12 is a perspective schematic illustration of yet another chair frame in accordance with the present invention fabricated of metal tubing pivolably interconnected, the central hinge brackets being deleted for clarity.
Figure 13:
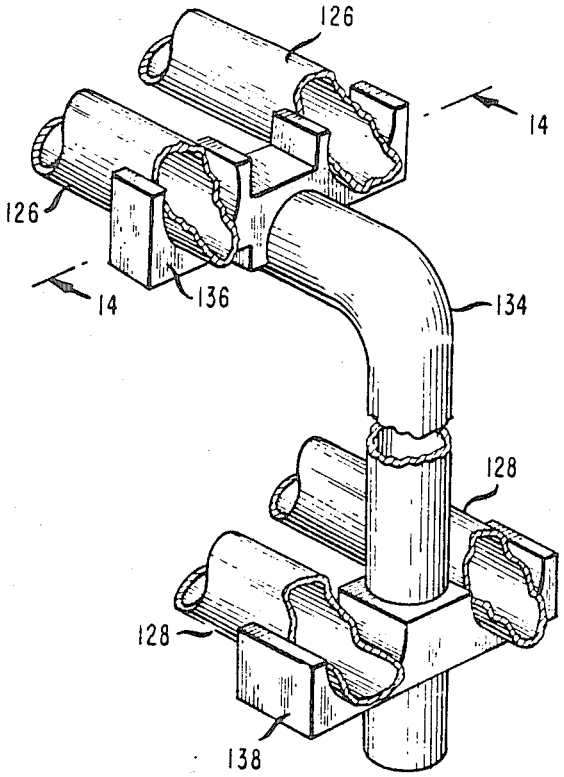
FIG. 13 is an enlarged perspective view of the central hinge brackets and central support portions of the chair frame of FIG. 12, as viewed generally from the line 13—13 of FIG. 12.
Figure 14:
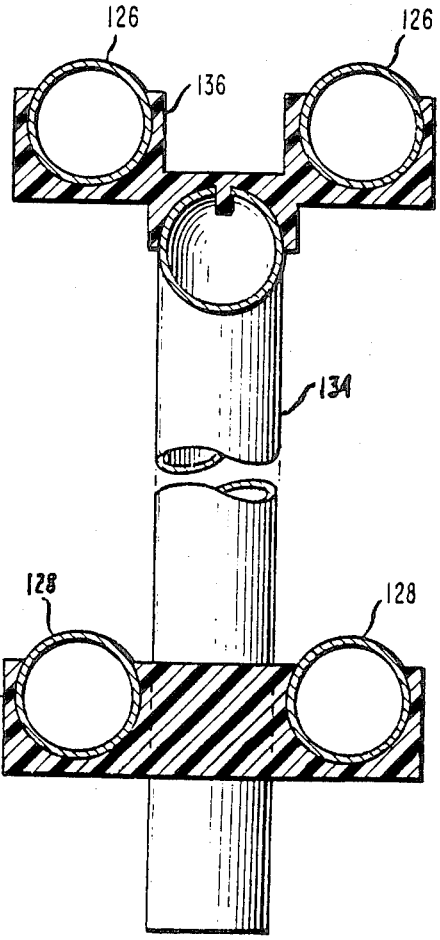
FIG. 14 is a yet further enlarged cross-sectional view taken along line 14—14 of FIG. 13.

Referring now to FIGS. 12 through 14, there is shown another form of chair frame in accordance with the present invention, fabricated of metal tubing and plastic fitments. The chair frame designated generally 122 comprises side frames 124 each fabricated, for example substantially from a single length of bent tubing with seat frame members 126 and lower parallelogram members 128 pivotally connected therewith, as by pivot pins 130. Cross braces 132 may also be provided. A center support 134 is also pivotally connected with the seat frame members 126, as by a pair of hinge brackets 136, FIGS. 13 and 14. A pair of lower pivot brackets 138 join the lower frame members 128 and the central support member 134 passes therethrough to provide support extending from the seat to the floor in use. The bonnet for the frame 122 may be provided with a rigid board like seat, appropriately cushioned, extending across the seat frames 126 in use. A flexible seat surface may also, of course be provided. Further, the bonnet (not shown) for the frame 122 may also be provided with a board-like back support member extending between the side frames 124 to provide additional rigidity beyond that provided by the fabric wrap which, as heretofore pointed out may be of a flexible yet non-stretchable material or fabric such as buckram or Tyvek. The tubular parts of the frame 122 may be fabricated, for example, of metal tubing, as of aluminum, and the hinge blocks 136 and 138 of plastic.

As clearly seen, therefore, the seat may be supported on either vertical struts mounted with the encircling fabric band, or on the central support frame member 134. In other words, therefore, at least one of the frame and the encircling band may provide the support for the seat frame portions in use.

While there have been described and illustrated several specific embodiments of the invention, it will be clear that variations in the details of the embodiments specifically illustrated and described may be made without departing from the true spirit and scope of the invention as defined in the appended claims.

I claim:

1. Portable upholstered furniture defined by a laterally foldable frame having a pair of laterally collapsible side frames and a pair of medially foldable parallelogram cross assemblies extending therebetween, means providing lateral support to said frame, a cushioned bonnet like upper assembly setable downwardly onto said frame and at least one vertically extending strut member supporting at least one of said cross assemblies.

2. Furniture defined in claim 1 further including a generally vertical tie-bar means extending between said cross assemblies.

3. Furniture defined in claim 2 wherein said tie-bar means in generally rigid and hingedly connected with both said cross assemblies.

4. Furniture defined in claim 1 wherein said cross assemblies are hingedly connected with said side frames.

5. Furniture defined in claim 1 wherein the upper one of said cross assemblies defines a seating surface and said seating surface comprises a resilient portion.

6. Furniture defined in claim 5 wherein said resilient portion comprises webbing or strip material stretched across a fenestration in said seating surface.

7. Furniture defined in claim 1 wherein the upper one of said cross assemblies defines a seating surface and at least one of said vertical struts extends upwardly therepast supporting a back portion of said bonnet like upper assembly.

8. Furniture defined in claim 7 wherein said side frames extend upwardly past said seating portion and define side arms.

9. Furniture defined in claim 7 where less than all of said side frames extend upwardly past said seating surface to define side arms, at least one of said side frames terminating at or below said seating surface and enabling said seating surface to extend therepast.

10. Furniture defined in claim 9 wherein there are at least three said side frames and two pairs of side by side cross assemblies hingedly mounted to opposite sides of an intermediate one of said side frames.

11. Furniture defined in 9 wherein said upper assembly provides cushioning for said side arms.

12. Furniture defined in claim 11 wherein said upper assembly includes channel members for engaging said side arms.

13. Furniture defined in claim 1 wherein said band is fabricated of weather resistant material.

14. Furniture defined in claim 1 wherein said bonnet is provided with rigid support means for reinforcing said frame.

15. Furniture defined in claim 1 wherein said bonnet is provided with a seat defining support board means extending across the seat parallelogram support surfaces.

16. Furniture defined in claim 1 wherein the strut member is provided as part of the frame.

17. Furniture defined in claim 1 wherein the strut member carries support means for supporting at least one of the cross assemblies.

18. Furniture defined in claim 1 wherein said means providing lateral support to said frame comprises at least one generally transversely flexible band of fabric or the like encircling the side frames and the cross assemblies.

19. Furniture defined in claim 18 wherein said cross assemblies are adjustable at least at the time of assembly to enable for adjustment to differing size encircling bands.

20. Furniture defined in claim 18 wherein said encircling band substantially covers the furniture surfaces viewable to a user while said upper portion covers substantially all of the furniture normally exposed tactily.

21. Furniture defined in claim 18 wherein said band is permanently affixed to said frame.

22. Furniture defined in claim 18 wherein said band is removably attached to said frame.

23. Furniture defined in claim 18 wherein the encircling band is provided with the strut member.

24. Portable upholstered furniture defined by a laterally foldable frame having a pair of laterally collapsible side frames and a pair of medially foldable parallelogram cross assemblies extending therebetween, at least one generally transversely flexible band of non-stretchable fabric or the like encircling the side frames and the cross assemblies and providing lateral support to the frame in use and a cushion.

25. Furniture defined in claim 24 further comprising a cushioned bonnet like upper assembly settable downwardly onto said frame.

* * * * *